US005293769A

United States Patent [19]

Schubert

[11] Patent Number: 5,293,769

[45] Date of Patent: Mar. 15, 1994

[54] FORGING MACHINE WITH DIE HOLDER LATERAL ADJUSTMENT

[75] Inventor: Peter Schubert, Kaarst, Fed. Rep. of Germany

[73] Assignee: SMS Hasenclever GmbH, Dusseldorf, Fed. Rep. of Germany

[21] Appl. No.: 998,593

[22] Filed: Dec. 30, 1992

[30] Foreign Application Priority Data

Dec. 30, 1991 [DE] Fed. Rep. of Germany ..... 4143175

[51] Int. Cl.[5] ..... B21J 7/02

[52] U.S. Cl. ..... 72/402; 72/446; 72/447; 72/453.01

[58] Field of Search ..... 72/402, 441, 446, 447, 72/453.01

[56] References Cited

U.S. PATENT DOCUMENTS 4,813,263 3/1989 Schubert et al. ..... 72/447
4,879,893 11/1989 Duri et al. ..... 72/447
4,905,495 3/1990 Pahnke ..... 72/447

*Primary Examiner*—David Jones
*Attorney, Agent, or Firm*—Jacobson, Price, Holman & Stern

[57] ABSTRACT

A forging machine has four forging rams (2) supported by the machine frame (1) for movement radially towards and away from the system axis (5) in an X arrangement at 90° to one another. Piston and cylinder units (12–15) on the machine frame each have a ram (2) as a constituent part and have a stroke corresponding to the working stroke of the ram. A crosshead (16) supports each piston and cylinder unit, and is adjustable (23–25) relative to the machine frame for setting the stroke position of the ram. An adjustable die holder (6) at the radially inner end of each ram adjusts a die (5) thereon in a direction transverse to the radial direction of the ram, so that the dies can be positioned with parts of their working surfaces overlapping side surfaces of adjacent dies to form a closed forging pass contour smaller than the working surfaces of the dies. Radially extending drive shafts (58) external to the rams and gear units (54–59) at the radially inner ends of the shafts adjust the die holders. Each gear unit is attached (57) to the associated ram, and a rotary coupling (60) is provided between each gear unit and a shaft drive device (63) for facilitating the die holder adjustment dependent on ram radial movement.

3 Claims, 7 Drawing Sheets

FORGING MACHINE WITH DIE HOLDER LATERAL ADJUSTMENT

BACKGROUND OF THE INVENTION

This invention relates to forging machines having die holder lateral adjustment.

For the forging of workpieces having a distinct longitudinal axis, forging machines are employed which are provided with four rams equipped with dies, arranged in an X arrangement within a plane, offset at 90° from one another, acting radially on the workpiece which is guided along the system axis. A forging machine of this generic type is known from European Patent EP 0 228 030 B1 and also U.S. Pat. Nos. 4,796,456 and 4,831,864, in which the rams guided in the machine frame constitute parts (single-piece or in combination) of piston-and-cylinder units with a stroke corresponding to the working stroke of the ram, and are adjustable in terms of their stroking position by crossheads which are adjustable relative to the machine frame and support the piston-and-cylinder units. The rams with the dies, which are transversely adjustable within their common plane by means of die holders mounted on the rams, are adjustable and fixable by actuator means, acting on the die holders, as a function of the stroke end position setting of the rams, such that the dies form a closed pass contour at their respective stroke end positions, with that part of their working surface protruding beyond the pass contour dimension overlapping a side surface of an adjacent die. The actuator means, the end members (toothed racks, link guides) of which are connected to the holders, are driven via shafts by motors which are secured to the adjustable crossheads, such that only the ram working stroke has to be accommodated in the drive connection from the motor to the end member of the actuator means.

In order to accommodate the shaft provided in the drive connection, the ram and its piston-and-cylinder unit must be provided with central through openings, or the shafts have to be arranged laterally next to the rams. The central arrangement of the shafts requires the provision of hollow shafts in the piston-and-cylinder units in order to be able to seal the piston and cylinder with respect to one another and to the central through openings, in the manner apparent from FIGS. 2, 3 and 6 of EP 0 228 030 B1. The constructional expense is correspondingly high, and accessibility to the components is impaired. Where the shafts are arranged laterally next to the rams, the drive connections between the shafts and end members of the actuator means cause difficulties, with the added problem that these components are exposed to the radiation heat and flying scale from the workpiece, as is apparent from FIG. 7 and 8 of EP 0 228 030 B1.

SUMMARY OF THE INVENTION

The invention is based on and utilizes the constructional simplification provided by arranging the shafts laterally alongside the rams, and has as its object to better adapt the drive connections between the shafts and the end members of the actuator means to the operating conditions, an object not achieved in the case of the arrangement described in EP 0 228 030 B1. In order to achieve the stated object, the invention provides for gear units of the actuator means to be connected to the rams, and to be connected to their drives via rotary couplings which compensate for the ram motion. The rotary couplings may be provided between the gear units of the actuator means and the shafts, between the parts of split shafts, or between the shafts and their drives, the rotary couplings in themselves permitting better protection against heat radiation and flying scale, but with their arrangement also being at a more protected position, i.e. a position which is less exposed to heat radiation and flying scale.

In a preferred embodiment of the invention, the known arrangement of the drive motors for the actuator means on the adjustable crossheads is abandoned, along with the apparent advantage that, in the drive connection from the motor to the end member of the actuator means, the stroke position setting does not need to be compensated; instead, the drives of the actuator means are secured to the machine frame and the rotary couplings for the gear units are dimensioned to compensate for both the working stroke and the stroke position setting of the rams. This offers the advantage that the shafts can be short, as a result of which sturdy support with a high degree of rotational rigidity may be achieved, as may a further advantage in the form of greater structural simplification and improved accessibility to the piston-and-cylinder units.

If, in accordance with a further feature of the invention, hydraulic oscillating motors with pinions rotated by pistons via racks are provided as the drives of the actuator means, the pinions thereof being connected at one end via telescopic shafts to the gear units of the actuator means, and at the other end to rotary transmitters which detect the actuated displacement, the conditions which prevail in forging operation are particularly well accommodated with regard both to structural compactness and to protection of the components against flying scale, heat radiation and mechanical stress.

BRIEF DESCRIPTION OF THE DRAWINGS

The invention will now be described in detail with reference to the accompanying drawings which show embodiments of the invention by way of example and wherein.

DETAILED DESCRIPTION OF PREFERRED EMBODIMENTS

Figure 1:
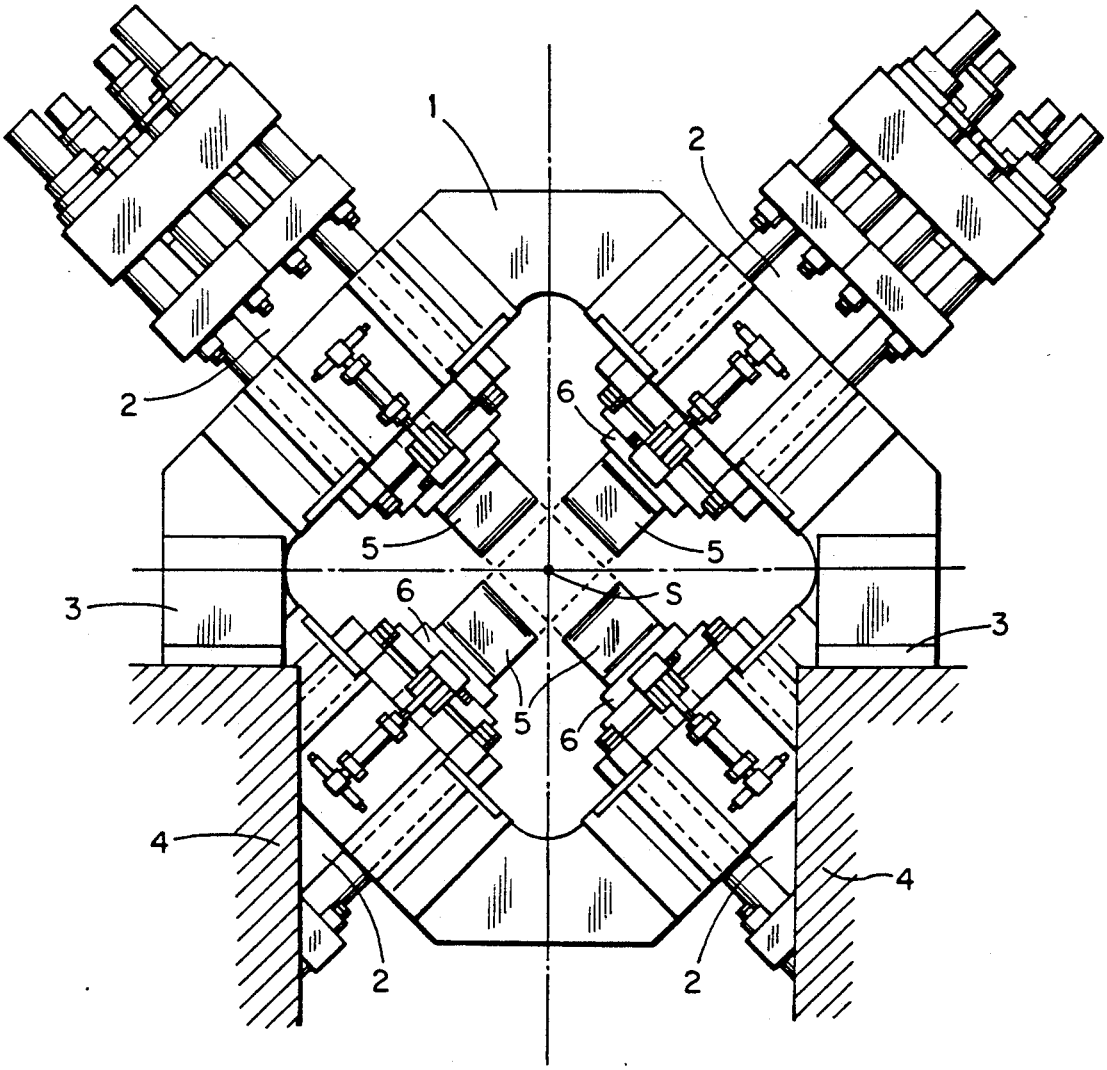
FIG. 1 is a general elevational view along the system axis S.
Figure 2:
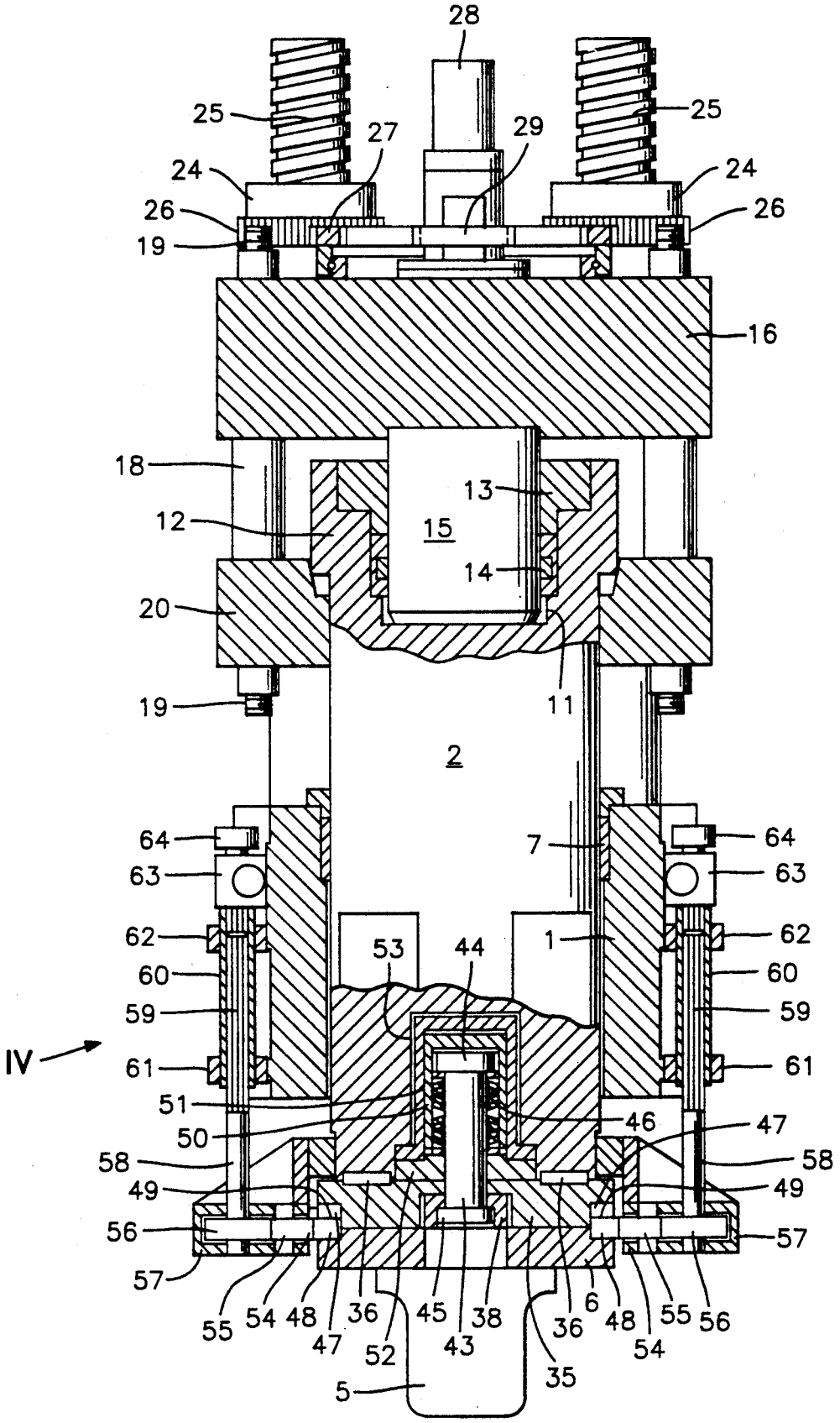
FIG. 2 is a larger-scale detail cross-sectional view taken on the line II—II in FIG. 5 in a plane containing the system axis S.
Figure 3:
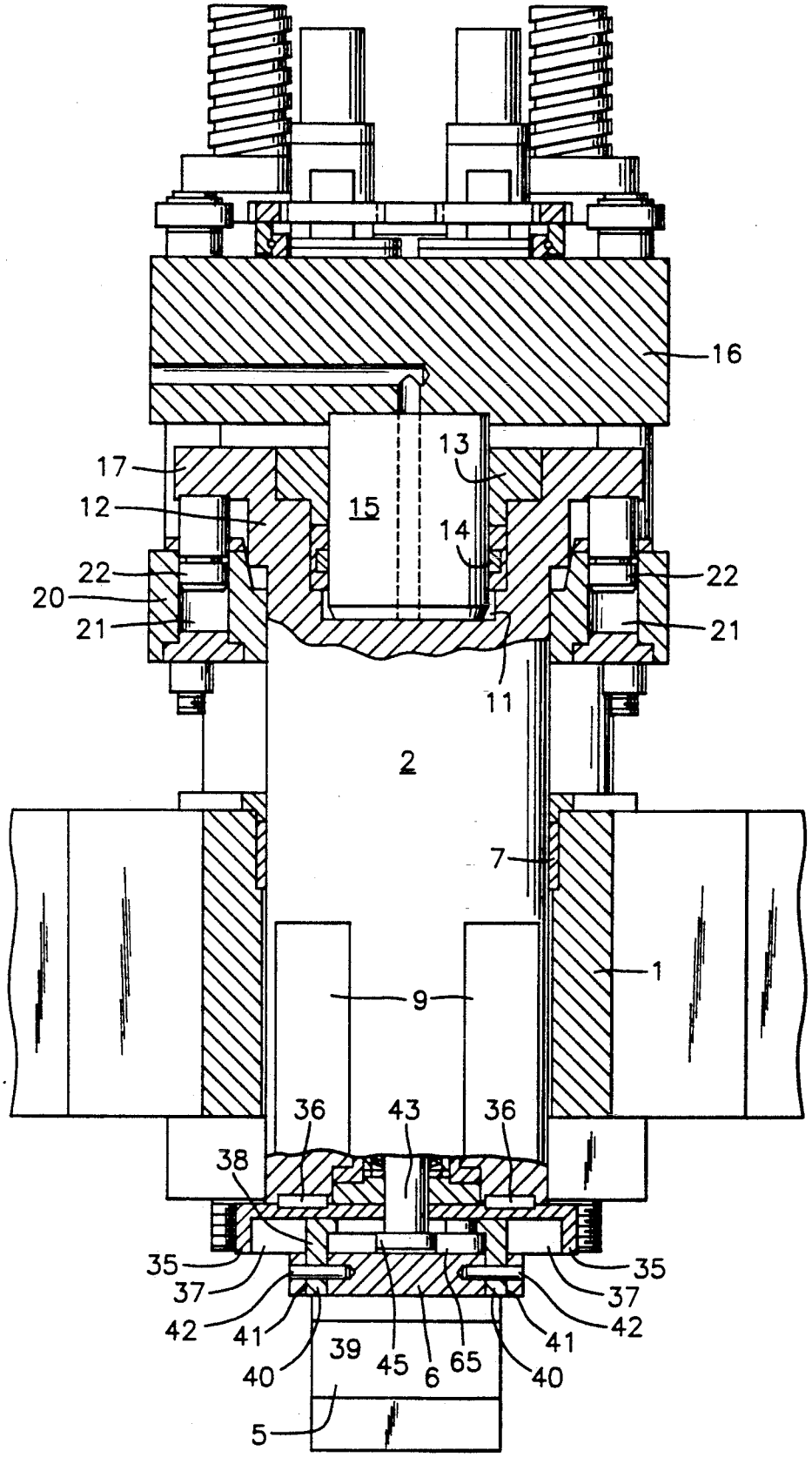
FIG. 3 is a cross-sectional view taken on the line III—III in FIG. 5 in the working plane at 90° to the axis S, in which the dies are adjusted.

The forging machine depicted in FIG. 1 as viewed in the direction along the system axis S comprises a frame 1 which guides four rams 2 in an X arrangement, grouping rams 2 together with their drives so that the rams 2 move radially in respect of the system axis S in a working plane perpendicular thereto. The frame 1 is provided on both sides front and rear with extensions 3 by means of which it is supported on piers 4 of a foundation. Each ram 2 is provided at its end face with a die 5, and in the stroke end positions of the rams 2, the dies 5 form a closed pass contour. In order to be able to form pass contours of which the side lengths are smaller than the width of the dies 5, the dies 5 are supported by holders 6 which are adjustable transverse to the axes of the rams 2 in the working plane, and the stroke end positions of the rams 2 are adjustable in the manner known from EP 0 228 030 B1.

In larger-scale details, FIG. 2 to 6 show one of the rams 2 with its guidance in the frame 1, its drive, its die 5 with holder 6 and the actuator means for transverse adjustment of the die 5 in the working plane.

Figure 6:
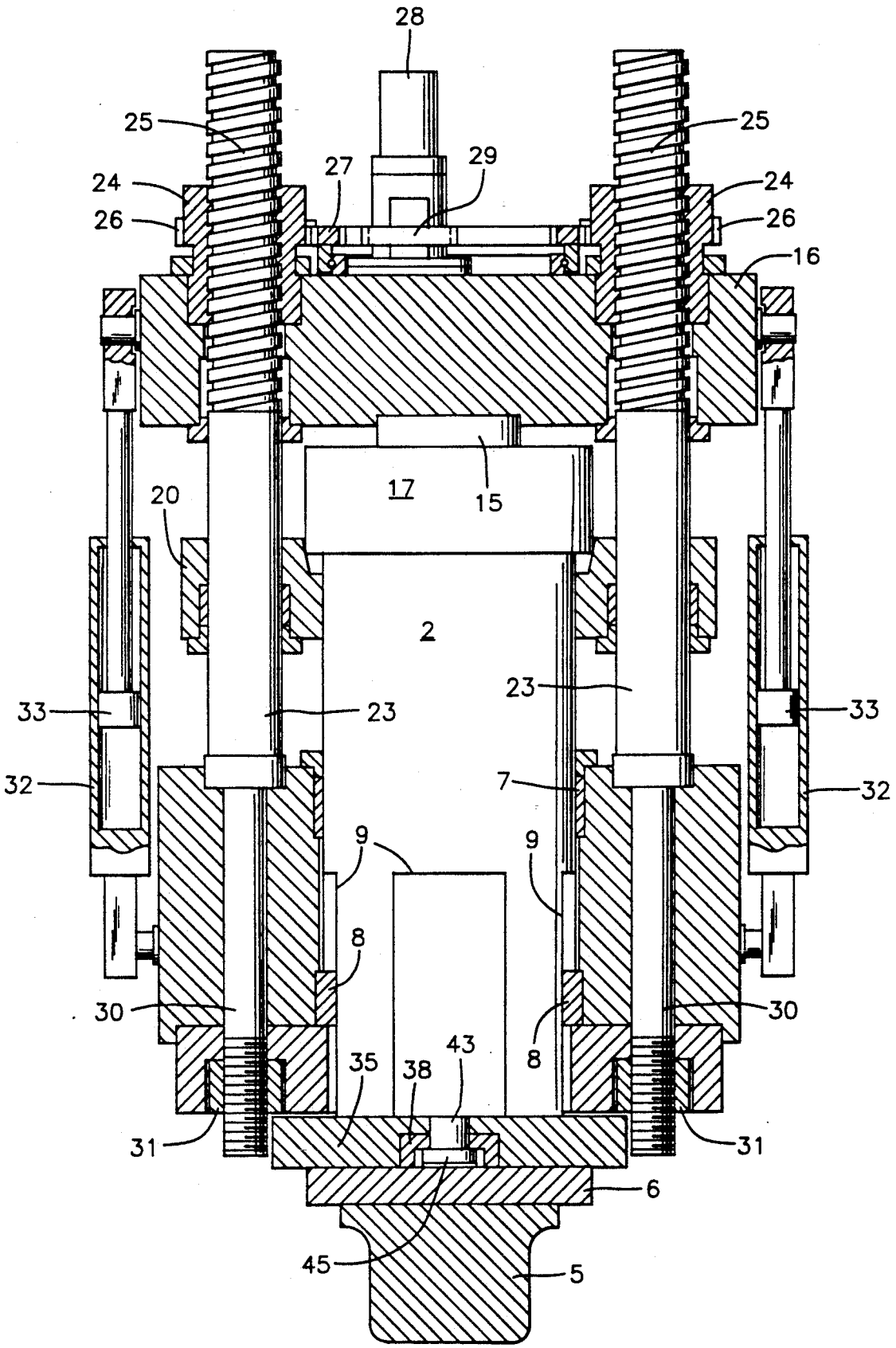
FIG. 6 is a further detail view of the first embodiment in cross-section taken on the line VI—VI in FIG. 5.

To guide the ram 2, the frame 1 is provided with a guide sleeve 7 and—as depicted in FIG. 6—with guide plates 8, which bear against flats 9 of the ram 2 and which prevent the ram 2 from rotating.

For drive purposes, the ram 2 is provided, at its end remote from the holder 6 with die 5, with a bore 11, and thus forms a cylinder 12. Inserted in the bore 11 is a closure ring 13 with a preceding ring seal 14, which surround a plunger piston 15. The plunger piston 15 is supported by a crosshead 16. In the region in which the ram 2 forms the cylinder 12, it is provided with a flange 17. A ring 20 connected by spacer sleeves 18 and tie rods 19 to the crosshead 16 surrounds the ram 2 and cylinder 12 and engages behind the flange 17. The ring 20 is provided with cylindrical bores 21 from which plunger pistons 22 are pushed against the flange 17 to effect the return stroke of the ram 2, while the working stroke of the ram 2 is effected by pressurization of the plunger piston 15 in the cylinder 12. The stroke of the cylinders 12 associated with the plunger pistons 15 and that of the plunger pistons 22 in the cylindrical bores 21 is limited to the working stroke of the rams 2. In order to be able to adjust the stroking position, i.e. the respective stroke end position of the rams 2, the crossheads 16 can be adjusted in the ram stroke direction with respect to the frame 1 of the forging machine. For this purpose, each crosshead 16 is, as depicted in FIG. 6, connected to the frame 1 by four tie-bars 23 extending through nuts 24 which are rotatably supported in the crosshead 16, which brace the crosshead 16 against the press force exerted at the plunger piston 15 and which can rotate on the threaded rods 25 of the tie-bars 23. The nuts 24 are provided with an external toothing 26 and are rotated in unison for each crosshead 16 by a ring gear 27 which is in turn rotated by geared motors 28, the drive pinion 29 of which engages in the internal toothing of the double-toothed ring gear 27. The stroking position of each ram 12 is thus adjustable and can be locked by means of brake devices at the geared motors 28. The tie-bars 23 are secured by means of shafts 30 and nuts 31 to the frame 1. The units formed from cylinders 32 connected to the frame 1, and pistons 33 connected to the crosshead 16, serve to preload the crosshead 16, in the direction of the working pressure, against backlash of the nuts 24 on the threaded rods 25.

For transverse displacement of the dies 5 within the working plane 1, each ram 12 is connected to a head plate 35, with keys 36 of crosswise arrangement, made in the end face of the ram 12 and the associated head plate 35, permitting differing degrees of thermal expansion of the ram 12 and head plate 35 while at the same time centering the head plate 35 with respect to the ram 12. The head plate 35 is provided with a longitudinal groove 37, the longitudinal extension of which falls in the working plane. Engaging in the longitudinal groove 37 is a cheek element 38 which is connected to the holder 6 and is provided with a longitudinal groove 39 with a T-shaped step, the narrower portion of which opens towards the head plate 35, and the wider portion of which opens towards the holder 6. At both ends the cheek element 38 is provided with tabs 40 which engage in slots 41 of the holder 6, where wedges 42 provide a detachable connection between the holder 6 and its cheek element 38 (see FIG. 3). To locate the die holder 6 with respect to the head plate 35, a tension pin 43 is provided which has a collar 44 and a mounted collar nut 45.

The collar nut 45 lies in the wider part of the T-shaped longitudinal groove 39, while an assembly of cup springs 46 presses on the collar 44 of the tension pin 43 so that the holder 6 connected to it is pressed via the cheek element 38 against the head plate 35. Connected to the head plate 35 are lateral strips 47, and connected to the holder 6 are lateral strips 48, which are provided with fine serrations on their surfaces facing one another in order to provide positive locking between the holder 6 and the head plate 35. Fitted over the tension pin 43, its collar 44 and the assembly of cup springs 46 is a pot-like plunger piston 50 which can be pressurized in a cylinder 51 within the ram, such that the assembly of cup springs 46 can be compressed, the cup springs 46 being supported on the disc 52 which covers the lower end of the cylinder 51. During this process, the collar nut 45 presses against the holder 6 and disengages the positive lock at the serrations 49 of the lateral strips 47 and 48. The cylinder 51 with the disc 52 are sunk in a bore 53 formed in the ram 2 at the end face thereof, which bore 53 is covered by the head plate 35 up to the through-bore for the tension pin 43. The lateral strips 48 connected to the holder 6 are each provided on their outward facing sides with toothing 54 with which they form end members of the actuator means for transverse displacement of the holders 6 with their dies 5. Engaged with the toothing 54 of the lateral strips 48 are pinions 55, with which further pinions 56 are meshed, with in each case a pinion 55 and a pinion 56 being housed in a gearbox 57, and the gearboxes 57 being secured to the ram 2 such that the gearboxes 57 together with pinions 55 and 56 and shafts 58 for driving the pinions 56 move with the ram 2. The shafts 58 are provided with splined ends 59, by means of which they engage in splined bores of hollow shafts 60 so that they are in rotationally fixed yet longitudinally displaceable connection. The hollow shafts 60 are mounted to the frame 1 in bearings 61 and 62, and driven by reversible or oscillating motors 63.

Figure 4:
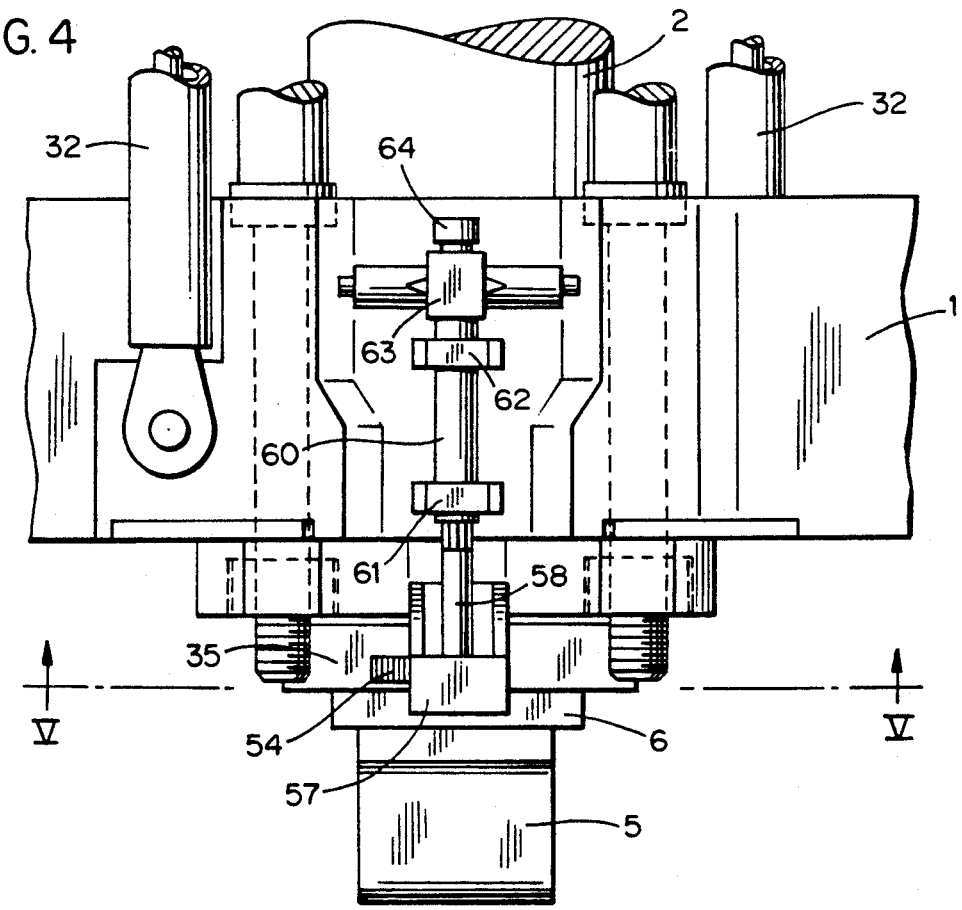
FIG. 4 is a detail view in the direction indicated by the arrow IV in FIG. 2.
Figure 5:
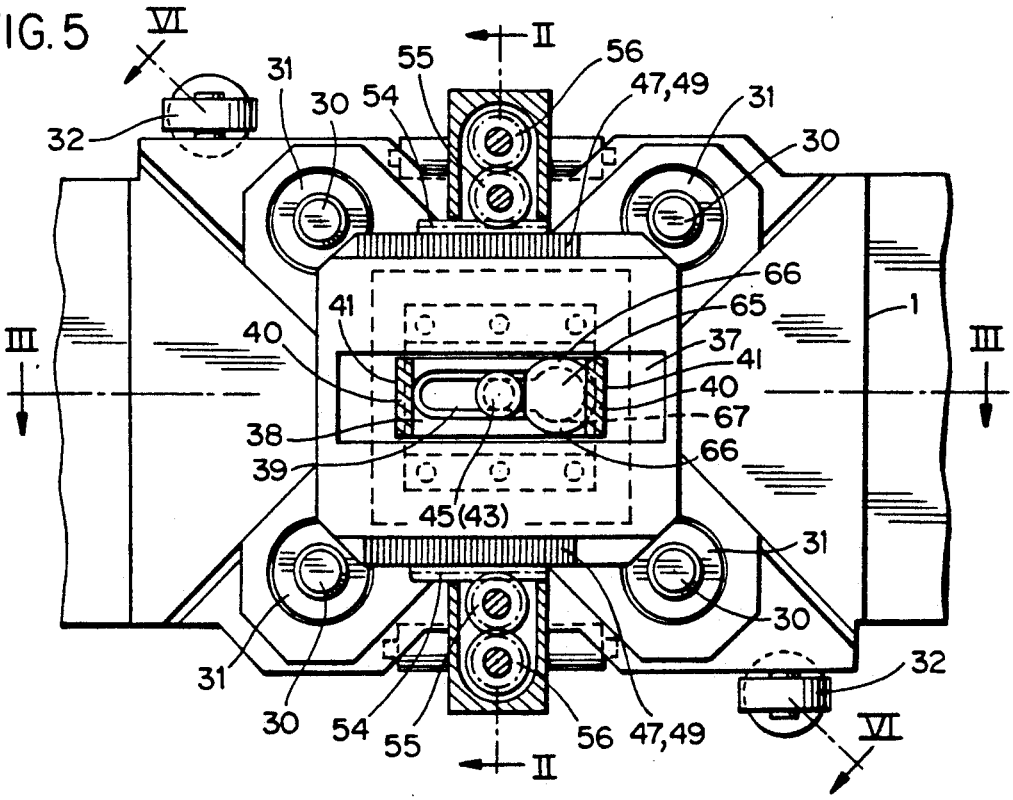
FIG. 5 is a cross-sectional view taken on the line V—V in FIG. 4 viewed in the direction of the ram axis, with the die removed.

In the embodiment, as is particularly illustrated in FIG. 4, hydraulic oscillating motors 63 of a known construction are provided, which comprise a pinion and a rack with both ends constructed as plunger pistons, in a casing forming two cylinder chambers. These oscillating motors 63 form with their pinion shafts two power take-off positions, one being coupled to the hollow shaft 60 and the other to a rotary transmitter 64 for detection of the rotary position, and thus of the transverse displacement of the holder 6. The transverse displacement detected by the rotary transmitter 64 is compared to the stroke position setting as adjusted by the geared motors 28. Once the transverse displacement of the holder 6 with die 5 has been effected in accordance with the stroke position setting, the plunger piston 50 is unloaded again so that the holder 6 with die 5 is once again firmly connected to the head plate 35 on the ram 2. As long as the plunger piston 50 remains unpressurized, operation of the oscillating motor 63 is inhibited. If the holder 6 is to be removed, the wedges 42 must be removed. Removal of the holder 6 renders accessible a closure element 65 (see in particular FIG. 5), which is secured by screws 66 in the cheek element 38. This closure element 65 closes the longitudinal groove 39 in the cheek element 38 at its end which widens into the form of a keyhole. Once the closure element 65 has been removed and the piston 50 has been pressurized, it is possible to move the cheek element 38 far enough for the keyhole widened part 67 of the longitudinal groove 39 to be pushed into the area of the collar nut 45, so that the cheek element 38 can be removed. Once the collar nut 45 has been removed from the tension pin 43, the head plate 35 can also be removed.

A modification of the embodiment would be possible in that the oscillating motor 63 with the hollow shaft 60 is supported not on the frame 1 but on the crosshead 16. This would enable the hollow shaft 60 to be of shorter construction, as it would only have to accommodate the working stroke of the ram 2, and not the stroke position setting as well. For this purpose, however, it would be necessary to provide shafts 58 extended into the area of the crosshead 16, a requirement which is generally less advantageous.

Figure 7:
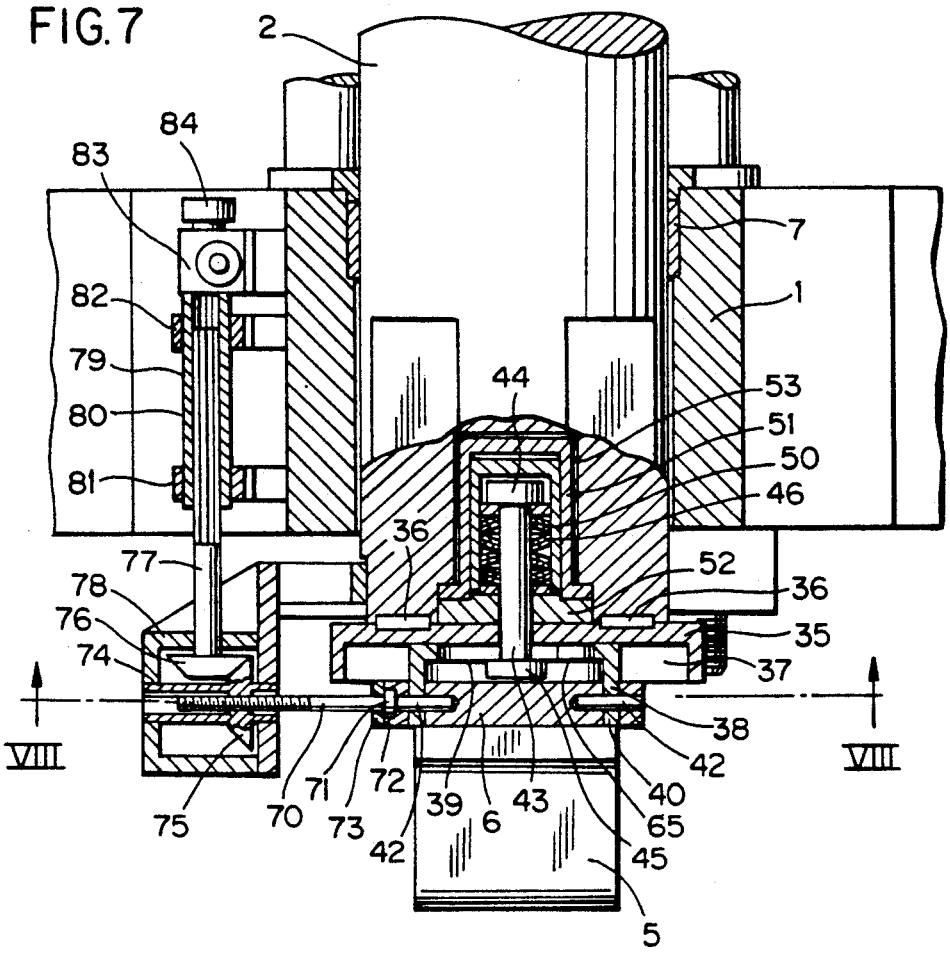
FIGS. 7 and 8 are views similar to FIGS. 4 and 5 showing a second embodiment of the invention.
Figure 8:
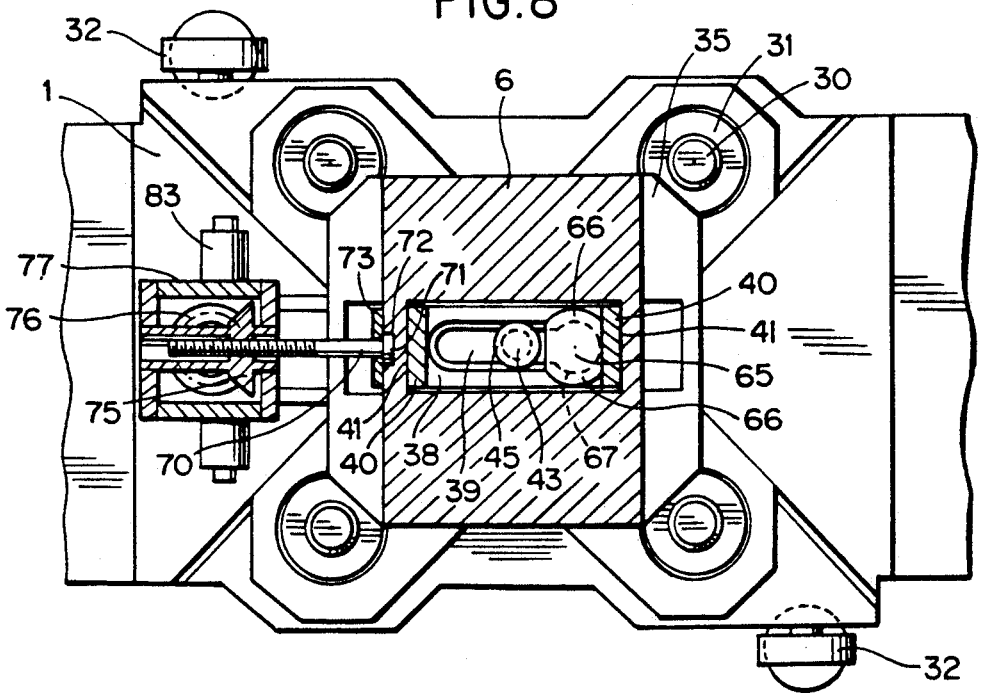

Another modification of the embodiment depicted in FIG. 1 to 6 is shown in FIG. 7 and 8; in the following, only the modification is described, reference being made to the description of the first embodiment in respect of the other features. For transverse displacement of the dies 5 in the working plane, in the case of the embodiment according to FIG. 7 and 8, a spindle 70 is provided in each case which engages centrally at the holder 6 concerned and is provided with a support bearing disc 71 and located in a bearing bore 72 in which it is held by a bearing cover 73 such that it is rotatable yet axially fixed. With a threaded part 74, the spindle 70 engages in a nut thread inside a bevel gear 75 which meshes with a second bevel gear 76 which is connected to a shaft 77. Both bevel gears 75 and 76, and the shaft 77, are located in a gearbox 78 which is secured to the ram 12 so that the gear box 78, together with the bevel gears 75 and 76 and the shaft 77, move with the ram 12. The shaft 77 engages by means of a splined end 79 in a hollow shaft 80 featuring a splined bore and is thus in longitudinally displaceable yet rotationally fixed connection. The hollow shaft 80 is mounted on the frame 1 in bearings 81 and 82, and it is driven by an oscillating motor 83 which is of the same design as each oscillating motor 63 in the embodiment according to FIG. 1 to 6, and which is connected to a rotary transmitter 84.

Figure 9:
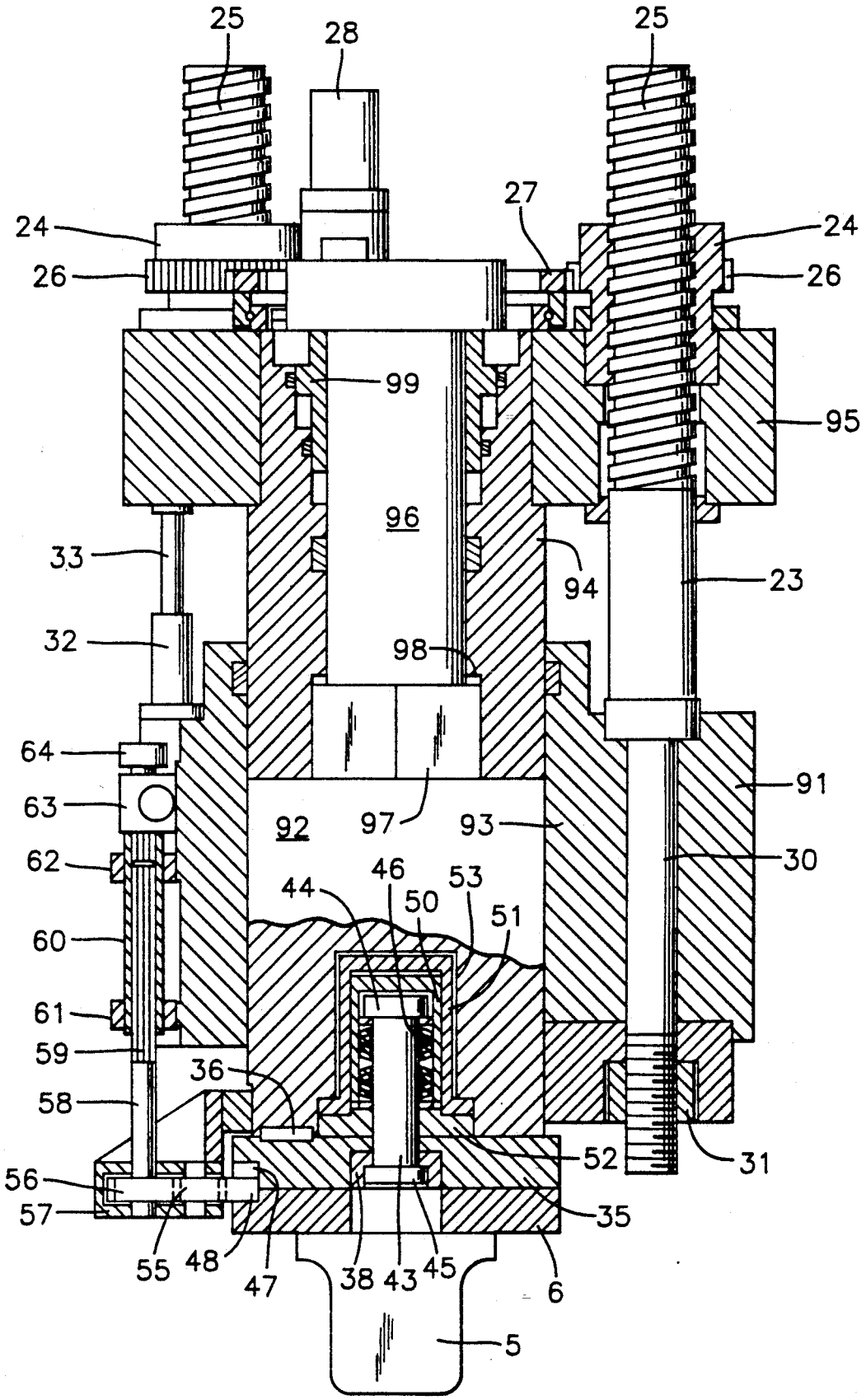
FIG. 9 is a cross-sectional view of a further embodiment in detail form in which the left-hand half corresponds to that according to FIG. 2, and the right-hand half corresponds to that of FIG. 6.

In the embodiment depicted in FIG. 9, the ram 92 is constructed as a piston which is guided in a cylinder 93 firmly connected to the frame 91, and which can be pressurized. The stroking position is here set by adjusting a plug device 94 which replaces the cylinder cap, plug device 94 being supported at a crosshead 95 which, like the crosshead 16 in the embodiment according to FIG. 1 to 6, is supported on the frame 1 and adjustable relative to the frame 1. The mounting and transverse adjustment means for the die 5 are also of identical construction to those of the embodiment according to FIG. 1 to 6. The reader is therefore referred to the relevant description in respect of FIG. 1 to 6. In order to secure the piston/ram 92 against rotation, a piston shaft 96 with a rectangular shoulder 97 is guided in a rectangular bore 98, the piston shaft 96 also having connected to it an annular piston 99 for the return stroke of the piston or ram 92.

I claim:

1. A forging machine comprising:

a machine frame having a system axis extending therethrough;

four forging rams slidably mounted in said frame and disposed in an X arrangement at 90° to one another within a common working plane transverse to said system axis, each ram having a ram axis and being supported and guided by said machine frame for movement along said ram axis radially towards and away from said system axis over a working stroke;

a radially inner end on each ram;

pressure fluid piston and cylinder units on said machine frame each comprising a respective one of said rams as a constituent part thereof and having a stroke corresponding to said working stroke of said ram;

a respective crosshead supporting each of said piston and cylinder units and adjustably supported for movement relative to said machine frame for moving a respective one of said piston and cylinder units and setting the stroke position and radially innermost end position of a respective ram;

a die holder mounted on said radially inner end of each ram and adapted for adjustment of a die carried thereon in use in a direction transverse to said ram axis and within said common plane, so that said die holder is adjustable for offsetting from said ram axis within said working plane in dependence on said innermost end position of said ram whereby dies on said die holders in use, each having a working surface facing said system axis and side surfaces adjacent said working surface, are adjustable with parts of said working surfaces overlapping side surfaces of adjacent dies to form radially inwardly of said innermost end positions of said rams a closed forging pass contour smaller than the working surfaces of the dies; and actuator means for moving each die holder in said direction transverse to said ram axis, each actuator means comprising a substantially radially extending holder drive shaft located externally of and adjacent to the associated ram and having radially inner and outer end portions, drive means for said holder drive shaft, a gear unit operatively engaging said radially inner end portion of said holder drive shaft in driving relation with said die holder and attached to the associated ram, and a rotary coupling between said gear unit and drive means for accommodating ram radial movement.

2. A forging machine as claimed in claim 1 wherein:

said drive means of said actuator means are secured to said machine frame; and said rotary couplings have dimensions to compensate for both said working stroke of said rams and said stroke position setting motion of said rams effected by adjustment of said crossheads.

3. A forging machine as claimed in claim 2 wherein:

each of said drive means comprises a hydraulic oscillating motor having output pinion means, hydraulically actuatable pistons, and a rack coupling said pistons to said pinion means for rotating said pinion means on actuation of said pistons;

each rotary coupling comprises a further shaft telescopically engaging said holder drive shaft and connecting one side of said output pinion means to said further shaft for rotating said shafts and said gear units; and rotary transmitters are provided on the side of said pinion means opposite said shafts for detecting the rotation of said pinion means and shafts effected by said motor and thereby detecting the transverse movement of each die holder effected by said actuator means.

* * * * *